United States Patent [19]

Lewis et al.

[11] Patent Number: 4,808,005

[45] Date of Patent: Feb. 28, 1989

[54] REGULATION OF THE FLOW-RATE OF CARBON BLACK INTO A PELLETIZER

[75] Inventors: William H. Lewis; Robert E. Adcock, both of Pampa, Tex.

[73] Assignee: Cabot Corporation, Waltham, Mass.

[21] Appl. No.: 876,277

[22] Filed: Jun. 19, 1986

[51] Int. Cl.[4] ..... B01F 7/16

[52] U.S. Cl. ..... 366/312; 366/196

[58] Field of Search ..... 366/196, 241, 244, 245, 366/247, 249, 250, 251, 279, 309, 310, 312, 313, 314, 325, 327, 329, 330

[56] References Cited

U.S. PATENT DOCUMENTS

| | | | |
|---|---|---|---|
| 1,997,035 | 4/1935 | Arbuckle | 366/309 |
| 2,027,756 | 1/1936 | Tay | 366/312 |
| 2,431,478 | 11/1947 | Hill | 366/329 |
| 3,734,469 | 5/1973 | Goldstein et al. | 366/327 |
| 4,515,483 | 5/1985 | Müller et al. | 366/313 |
| 4,552,461 | 11/1985 | Ott et al. | 366/312 |

*Primary Examiner*—Harvey C. Hornsby
*Assistant Examiner*—Corinne M. Reinckens
*Attorney, Agent, or Firm*—Lawrence A. Chaletsky

[57] ABSTRACT

The disclosure relates to a process and apparatus for dispensing a uniform flow of carbon black from a tank. The process is carried out by stirring the carbon black in a surge tank, providing equal movement of the carbon black away from the center of the surge tank towards the outlet(s) of the surge tank and removing caked carbon black from the wall of the tank and/or minimizing caking of carbon black on the wall of the surge tank. The apparatus includes horizontal blades for stirring the carbon black, lifters for lifting carbon black from the bottom of the tank, impeller vanes shaped in the form of curves such that each segment of rotation of the vanes causes an equal movement of the carbon black away from the center of the surge tank towards the tank outlet(s), and side scrapers for removing caked carbon black from the wall of the tank and/or minimizing caking of carbon black on the wall of the surge tank.

5 Claims, 3 Drawing Sheets

REGULATION OF THE FLOW-RATE OF CARBON BLACK INTO A PELLETIZER

FIELD OF THE INVENTION

This invention is in the field of carbon black. More specifically, this invention relates to the production of a homogenous mixture of various types of carbon black to promote a constant rate of flow of carbon black into a pelletizer.

BACKGROUND OF THE INVENTION

High temperature, incomplete combustion of a hydrocarbon such as petroleum, natural gas and other well known materials produces carbon black. When separated from the reaction gases, the product is a fluffy, carbon black powder.

In a typical furnace process for the production of carbon black, a fuel, an oxidant such as air, and a feedstock are reacted to provide a hot stream of combustion gases containing carbon black therein. The combustion gas stream is then quenched to a lower temperature by means of a water spray. The black is separated from the stream of gases in which it is suspended by known techniques, such as by cyclones and filters, and then conveyed to a pelletizer and subsequently dried.

Often, a short-term storage tank, called a surge tank, is located between the collection equipment and the pelletizing equipment to aid in providing a steady feed of carbon black to the pelletizer. A typical tank has a height of 10–15′, the upper portion of said tank being cylindrical with a diameter of about 9′. The height of the cylindrical portion of the tank is approximately ¾ of the total height of the tank. The lower remaining portion of the tank is in the form of a truncated cone, with a diameter decreasing from 9′ at the top-most portion of the cone to between 4.5–6′ at the flat bottom of the tank. The carbon black, which may be in the form of dry powder, moist powder and/or reprocessed pellets, enters at the top of the tank and is emitted through outlets at the bottom of the tank into one or more pelletizers where the carbon black is formed into pellets.

Carbon black can be formed into pellets by the well-known technique of wet-pelletization. Wet-pelletization is a process whereby carbon black material is formed into beads or pellets of increased density, cohesive strength and nondusting characteristics. In this process, carbon black is wetted, usually with water, and agitated in a conventional pelletizer. One of the major control problems in the wet-pelletization of carbon black is that of maintaining a proper balance of the mass flow rates of pelletizing liquid and carbon black powder that are injected into the pelletizer so that optimum pellet moisture content is achieved. It is not difficult to control the mass flow rate of the pelletizing liquid since the density of the liquid does not change appreciably. The volumetric rate of carbon black can also be closely controlled. However, variations in the density of the carbon black are often significant and occur frequently. These variations in the density of the carbon black within the surge tank can cause the mass flow rate of the carbon black from the surge tank to the pelletizer to fluctuate. This fluctuation in mass flow rate can cause the moisture content in the resulting carbon black pellets to vary. Many types of equipment have been used to feed carbon black powder from the surge tank to the pelletizer but none have provided a dependable stable mass flow rate of carbon black from the surge tank into the pelletizer.

SUMMARY OF THE INVENTION

This invention relates to a process and apparatus for mixing and agitating various types of carbon black in a surge tank so as to provide a more uniform mixture of carbon black having a more uniform density. By producing in the surge tank such a mixture of carbon black, a more uniform, stable mass flow rate of carbon black is supplied to the pelletizer.

In general the process entails the following operations. Carbon black is stirred on at least two separate vertical levels of the surge tank. Carbon black at the bottom of the tank is lifted by lifting means; carbon black is pushed equally away from the center of the tank toward the outlet(s) at the bottom of the tank; and caking of carbon black on the wall of the tank is minimized and cake that may have formed on the wall is removed by scraping means which rotate in close proximity to the wall of the tank.

An apparatus suitable for carrying out this invention is comprised of the following elements which are inside the surge tank. The elements are comprised of stainless steel or any other material of similarly sufficient strength which will not contaminate the carbon black.

(1) Horizontal blades are attached to a vertical rotating shaft, said horizontal blades being located on at least two levels of said vertical shaft, the lowest being sufficiently close to the bottom of the tank so that the rotation of the blades keeps the carbon black at the bottom of the tank in motion. The highest horizontal blades are placed at a level sufficiently low so that they will not interfere with vertical probes extending downward from the top of the tank for the purpose of measuring the level of carbon black in the tank.

(2) Lifters are attached to the ends of the horizontal blades closest to the bottom of the tank to lift the carbon black which is located at the bottom of the tank, the lifters being pointed in the direction of movement of the horizontal blades and, preferably, angled vertically at 45° relative to the horizontal blade.

(3) Vertical or helical side scrapers extend out from and are attached to the ends of the lowest coaxial horizontal blades, conform to the shape of the tank wall, and are attached to corresponding ends of the top-most coaxial horizontal blades, said side scrapers rotating sufficiently close to the wall of the tank to remove carbon black cake that may have formed and/or minimize carbon black from building up on the wall of the tank, said scrapers being, preferably, located within two inches of the tank wall, the edges of the side scrapers can also be beveled in the direction of movement of the side scrapers.

(4) Impeller vanes shaped in the form of curves are attached to the vertical shaft just above the lowest horizontal blades; the outer ends of the impeller vanes are supported by and connected to upright bars, said bars being connected to the ends of the horizontal blades located closest to the bottom of the tank and to the ends of the next higher set of coaxial horizontal blades; the impeller vanes extend out to the edges of the tank outlets; each segment of rotation of the impeller vanes causes an equal movement of carbon black away from the center of the tank and toward the edges of the tank outlets.

The above and other features of the invention including various novel details of construction and combinations of parts will now be more particularly described with reference to the accompanying drawings and pointed out in the claims. It will be understood that the particular surge tank embodying the invention is shown by way of illustration only and not as a limitation of the invention. The principles and features of this invention may be employed in varied and numerous embodiments without departing from the scope of the invention.

DETAILED DESCRIPTION OF THE INVENTION

Figure 1:
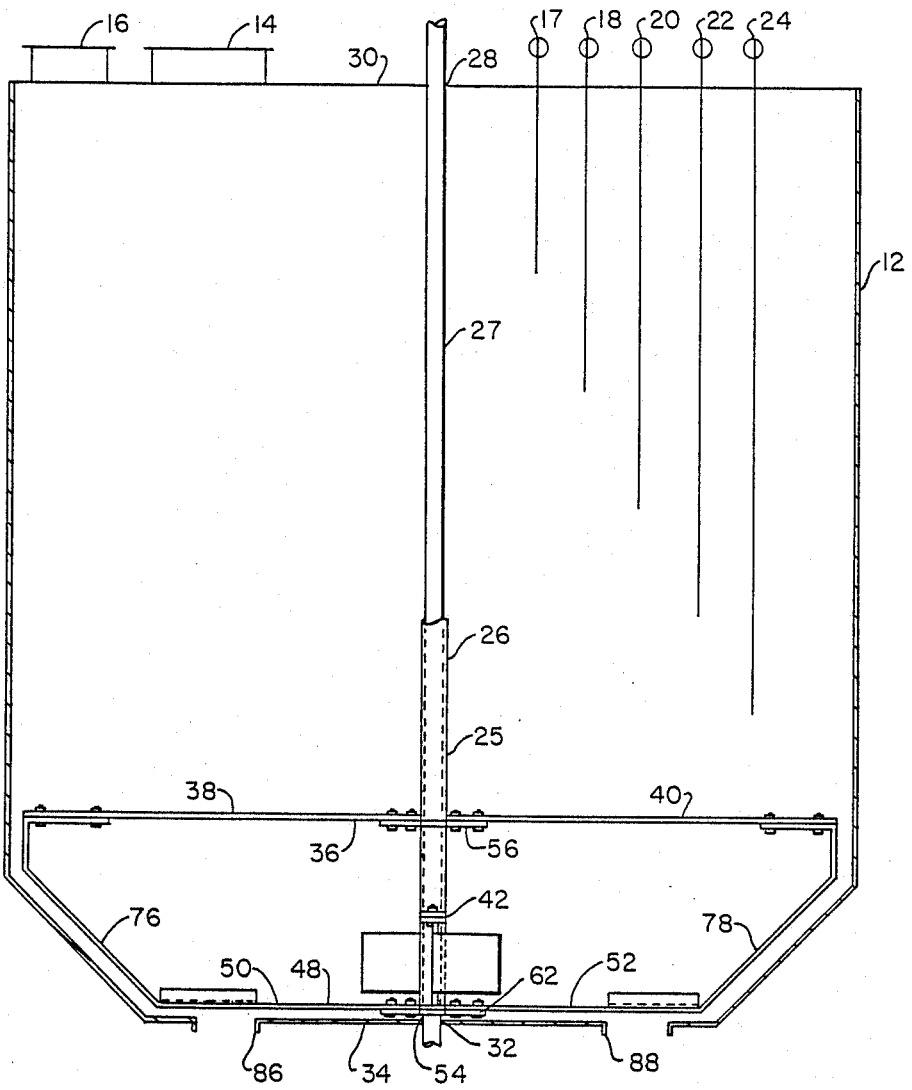
FIG. 1 is a frontal elevation, partly in section, of a surge tank.

The process for mixing and agitating carbon black in a surge tank is comprised of stirring the carbon black on at least two separate vertical levels within the tank the lowest of which being sufficiently close to the bottom of the tank to maintain the carbon black located at the bottom of the tank in motion; lifting the carbon black situated near the bottom of the tank; equally moving the carbon black away from the center of the tank and towards the tank outlet(s); and minimizing buildup of carbon black on the wall of the surge tank and/or removing carbon black cake from the wall of the tank that may have already formed.

The carbon black is stirred by any suitable means such as coaxial horizontal blades which are attached to a vertical rotating shaft in the surge tank. The horizontal blades are located on at least two levels of the tank, the lowest set of coaxial blades being sufficiently close to the bottom of the tank so that the rotation of the blades will maintain the carbon black located at the bottom of the tank in motion.

The vertical level at which the top-most horizontal blades can be located is limited by the depth to which vertical probes, which are placed in a typical surge tank for measuring levels of carbon black in the tank, extend downwardly from the top of the tank. The top-most horizontal blades cannot be placed at any height that would cause interference with the probes. These vertical probes are necessary to monitor the level of carbon black within the surge tank. Preferably, the top-most set of coaxial horizontal blades should be located at the upper level of the bottom third of the surge tank to ensure thorough stirring of the carbon black mixture immediately prior to entry into the pelletizer.

The carbon black situated near the bottom of the tank is lifted by lifters which are attached to the ends of the horizontal blades closest to the bottom of the tank. The carbon black is simultaneously lifted by the lifters and stirred by the horizontal blades. The lifters are pointed in the direction of rotation of the blades.

Caking of carbon black on the wall of the tank is minimized and carbon black cake that may have formed is removed by means of side scrapers. The scrapers are either vertical or helical, extend outwardly and conform to the shape of the tank. The scrapers are attached to the ends of the coaxial horizontal blades closest to the bottom of the tank and to the ends of the highest horizontal blades. The scrapers extend sufficiently close to the wall of the tank to remove caking of carbon black from the wall of the tank that may have formed, and/or minimize carbon black from caking on the tank wall. The scrapers should, preferably, be located within two inches of the tank wall. The edges of the side scrapers may also be beveled in the direction of movement of the side scrapers.

Carbon black is moved equally from the center of the tank towards the outlet(s) of the tank by suitable means such as impeller vanes. The impeller vanes are shaped in the form of curves and are attached to the vertical rotating shaft just above the lowest horizontal blades. The vanes are supported by means of vertical upright bars, the ends of which are attached to the lowest set of horizontal blades and to the set of coaxial horizontal blades which is on the next higher vertical level.

FIG. 1 illustrates a stainless steel surge tank 12 containing the elements of this invention. Carbon black enters the surge tank through opening 14. Ventilation of the air in the surge tank is provided by vent 16. Probes 17, 18, 20, 22 and 24 measure the level of carbon black in the surge tank 12. A rotating vertical shaft 26 is located in the center of the surge tank. The shaft is comprised of an inner iron core 27 and an outer stainless steel jacket 25. The rotating shaft is placed through an opening 28 in the center of the top 30 of the surge tank and extends down through the center of the tank through opening 32 in the bottom 34 of the tank 12.

Attached to the rotating shaft 26 are four sets of coaxial horizontal blades 36, 42, 48 and 54. The highest set of horizontal blades 36 is comprised of horizontal blades 38 and 40. Horizontal blades 38 and 40 are attached by means of bolts onto a metal plate 56 which is welded onto vertical shaft 26. Horizontal blades 38 and 40 are coaxial and extend out toward opposite points of the cylindrical wall of the tank.

The next set of horizontal blades 42 is positioned approximately midway between the highest set of horizontal blades 36 and the lower sets of horizontal blades 48 and 54. Horizontal blades 44 and 46 of set 42 (see FIG. 2) are at right angles relative to the corresponding blades 38 and 40 of set 36. Horizontal blades 44 and 46 are attached by means of nuts and bolts to metal plate 58, said metal plate being welded onto vertical rotating shaft 26.

There are two sets of horizontal blades 48 and 54 positioned at the same level on the vertical shaft 26 near the bottom 34 of surge tank 12. These sets of horizontal blades 48 and 54 are sufficiently close to the bottom of the tank so that the rotation of the blades keeps the carbon black at the bottom of the tank in motion. This distance is usually about one inch from the bottom of the tank. The set of horizontal blades 54 is parallel to set 42 (see FIG. 2) and the set of blades 48 is parallel to the highest set of horizontal blades 36. The set of horizontal blades 48 is comprised of two blades 50 and 52 which are attached by means of nuts and bolts onto plate 62 which is welded onto rotating vertical shaft 26. Horizontal blades 50 and 52 extend out toward opposite points of the wall of tank 12. The set of horizontal blades 54 (see FIG. 2) is comprised of blades 64 and 66 attached by means of nuts and bolts to plate 68 which is welded onto vertical shaft 26. Horizontal blades 64 and 66 extend toward opposite points along the wall of the tank.

Figure 3:
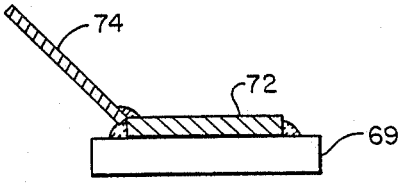
FIG. 3 is a detail view of a lifter employed with the surge tank.

FIG. 3 illustrates a lifter attached to a horizontal blade. A stainless steel bar 72 is welded onto the end of the horizontal blade 69. Lifter 74 is then welded upwardly at a 45° angle relative to the horizontal blade onto both the top surface of the horizontal blade and onto the edge of bar 72. Lifter 74 is pointed vertically in the direction of movement of the horizontal blade.

Welded to the end of horizontal blade 50 in FIG. 1 is side scraper 76 which extends out and conforms to the contour of the wall of the tank. Side scraper 76 extends up and along the wall of the tank and makes a 90° bend immediately below horizontal blade 38. The end of side scraper 76 is attached to the end of horizontal blade 38 by means of nuts and bolts. Side scraper 76 is sufficiently close to the wall of the tank to remove caking of carbon black that may hve formed on the wall of the tank, and/or minimize carbon black from caking on the wall of tank 12. In this case, scraper 76 is located within two inches of the wall of the tank. In a similar manner, side scraper 78 extends out and is welded onto the end of horizontal blade 52. Side scraper 78 makes a 90° bend toward vertical shaft 26 immediately beneath horizontal blade 40. The end of the scraper is attached to the end of horizontal blade 40 by means of nuts and bolts.

Figure 2:
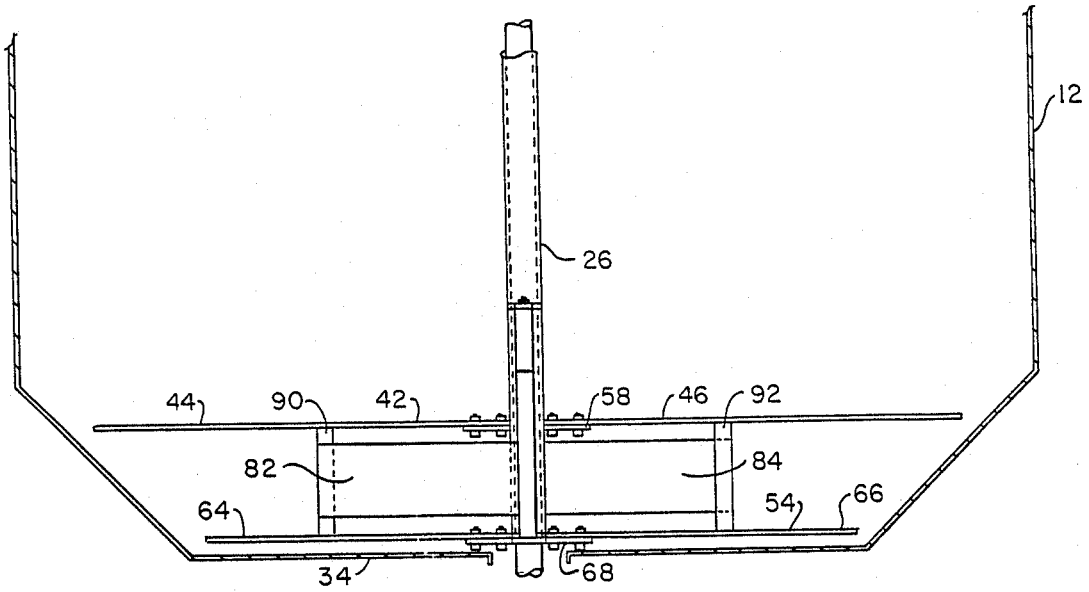
FIG. 2 is a side elevation, partly in section, of the surge tank shown in FIG. 1.
Figure 4:
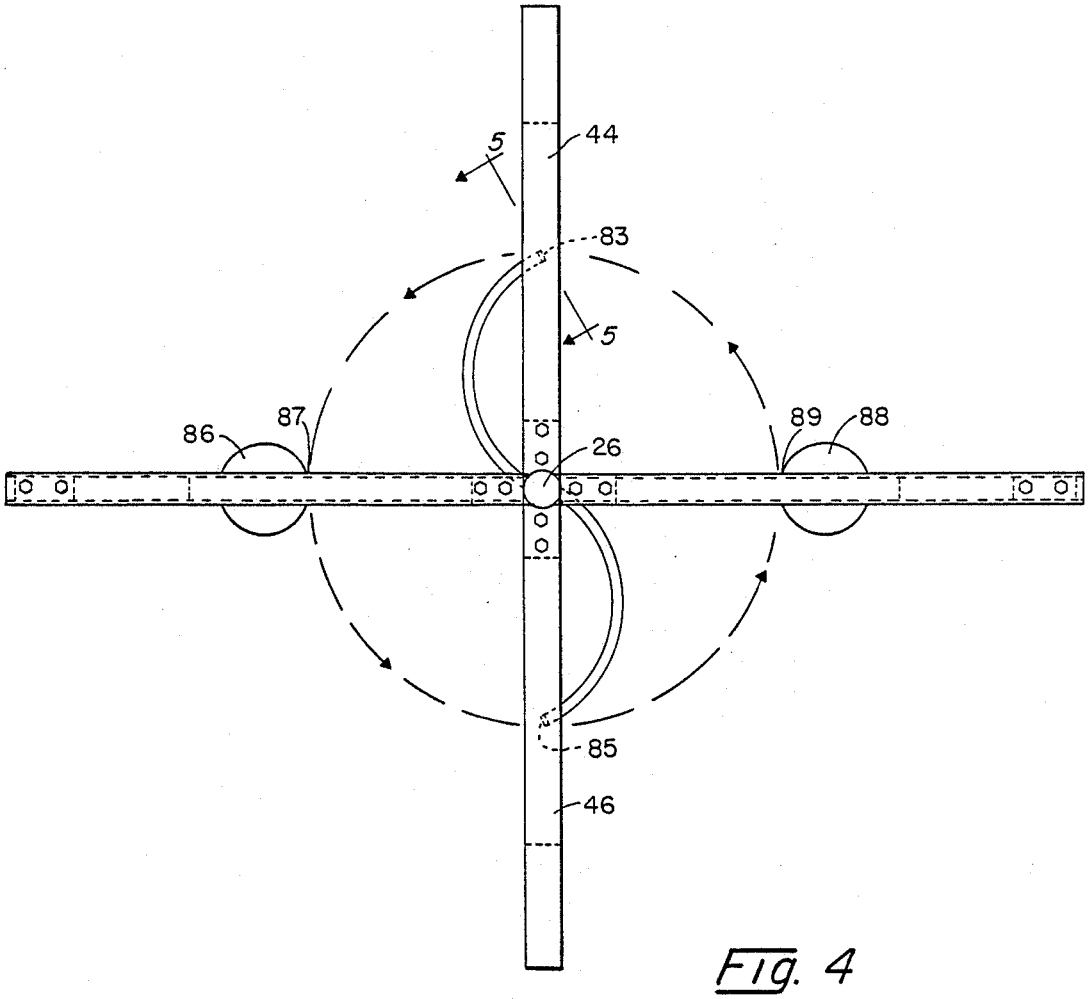
FIG. 4 is a plan view of the mixing elements of the surge tank.

In FIG. 2, two impeller vanes 82, 84 are located between the lowest set of horizontal blades and the next set of horizontal blades 42. The impeller vanes are welded onto vertical shaft 26 such that as vertical shaft 26 rotates, the impeller vanes rotate in the direction of the convex portion of said impeller vanes. The impeller vanes (see FIG. 4) extend out from the vertical shaft 26 to the inner edge of the tank outlets 86 and 88, that is to the edge of the tank outlet closest to vertical shaft 26. The impeller vanes aree placed in such a manner that the widths of said vanes are vertical. The end points 83 and 85 of the convex portion of the impeller vanes extend to the inner edges 87 and 89 of of the tank outlets.

The impeller vanes are supported at their ends by vertical bars 90, 92 (see FIG. 2). The ends of vertical bar 90 are attached to horizontal blades 44 and 64. The end of impeller vane 82 is attached to and supported by vertical bar 90. The ends of vertical bar 92 are attached to horizontal blades 46 and 66. The end of impeller vane 84 is attached to and supported by vertical bar 92.

Figure 5:
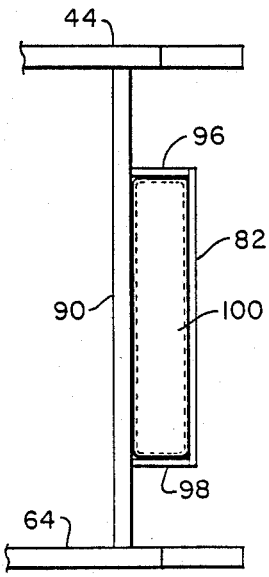
FIG. 5 is a detail view of an impeller vane.

FIG. 5 illustrates one technique for attaching an impeller vane to a vertical support bar. One end of the vertical support bar 90 is welded onto the bottom of horizontal blade 44 and the other end of the support bar 90 is welded onto the top of horizontal blade 64. Two strips of stainless steel 96 and 98 are welded to the top and bottom edges respectively of the impeller vane 82 at the end of the impeller vane most distant from the vertical shaft 26. The strips of stainless steel extend toward vertical support bar 90 and are welded perpendicularly onto the side of the bar. Additional support is provided by a rectangular stainless steel cover 100. Cover 100 fits tightly within the rectangular support structure formed by stainless steel strips 96 and 98 being welded onto the impeller vane 82 and vertical support bar 90. The edges of the cover 100 fit within and are welded to the rectangular support structure. The cover serves to prevent the impeller vane from being deformed as the result of moving carbon black.

EQUIVALENTS

Those skilled in the art will recognize or be able to ascertain, using no more than routine experimentation, many equivalents to the specific embodiments described herein. Such equivalents are intended to be covered by the following claims.

We claim:

1. A process for mixing and agitating various types of carbon black in a surge tank having one or more inlet port(s) and one or more outlet port(s), which comprises:

(a) stirring the carbon black on at least two separate vertical levels within the surge tank, the lowest level being sufficiently close to the bottom of the surge tank to keep the carbon black located at the bottom of the tank in motion;

(b) lifting carbon black near the bottom of the tank and thereby decompacting the carbon black at the outlet(s) of the tank;

(c) moving equally the carbon black away from the center of the tank and toward the tank outlet(s):

(d) removing caked carbon black from the wall of the surge tank, and/or minimizing caking of carbon black on the wall of the tank.

2. A process for mixing and agitating various types of carbon black in a surge tank having one or more inlet port(s) and one or more outlet port(s), which comprises:

(a) stirring the carbon black by means of at least two sets of coaxial horizontal blades attached to a centrally positioned vertical rotating shaft, said horizontal blades being located on at least two levels, the lowest horizontal blades being sufficiently close to the bottom of the surge tank so that carbon black at the bottom of said tank is stirred upon rotation of said blade;

(b) lifting the carbon black near the bottom of the tank and thereby decompacting the carbon black at the outlet(s) of the tank;

(c) moving the carbon black away from the center of the surge tank and toward the tank wall outlet(s), by means of impeller vanes attached to the vertical shaft above the lowest horizontal blades, said vanes being shaped in the form of curves such that each segment of rotation of the vanes causes an equal movement of the carbon black away from the center of the tank and toward the edges of the tank outlets, and said vanes extending to the inner edges of the outlet port(s) of the surge tank;

(d) removing caked carbon black from the wall of the surge tank, and/or minimizing the caking of carbon black on the wall of the surge tank by means of side scrapers, said side scrapers being attached to the ends of the lowest horizontal blades and conforming to the shape of the wall of the tank.

3. A process as recited in claim 2, wherein the lifters are attached at a 45° angle on the top side of the horizontal blades and are pointed in the direction of motion of said horizontal blades.

4. An apparatus for the mixing and agitation of various types of carbon black in a surge tank having one or more inlet port(s) and one or more outlet port(s), which comprises:

(a) a vertical rotating shaft centrally located within the surge tank;

(b) at least two sets of horizontal blades attached to said rotating shaft on different levels, each set of blades being comprised of two coaxial blades extending out towards opposite points on the wall of the surge tank, the lowest set of horizontal blades being sufficiently close to the bottom of the surge tank so that the carbon black at the bottom of said tank is stirred and maintained in motion upon the rotation of said blades;

(c) lifters attached to the lowest horizontal blades which thereby decompact the carbon black at the outlet(s) of the tank;

(d) side scrapers attached to the ends of the lowest and highest sets of horizontal blades, said scrapers extending vertically along and conforming to the shape of the wall of the tank, said side scrapers rotating sufficiently close to the wall of the tank to minimize caking of carbon black on the wall of the tank and/or to remove caked carbon black from the wall of the surge tank;

(e) impeller vanes attached to the vertical shaft at a point above the lowest set of horizontal blades and below the next higher set of horizontal blades, said impeller vanes being shaped in the form of curves such that each segment of rotation of the vanes causes an equal movement of the carbon black away from the center of the tank and toward the edges of the tank outlets, and said vanes extending to the inner edges of the outlet(s) of the tank.

5. An apparatus as recited in claim 4, wherein the lifters are attached to the ends of the lowest horizontal blades upwardly at a 45° angle relative to said horizontal blades and are pointed in the direction of motion of said horizontal blades.

* * * * *